US006138830A

United States Patent [19]

Muggli

[11] Patent Number: 6,138,830

[45] Date of Patent: Oct. 31, 2000

[54] CHILDPROOF PACKAGING FOR TABLETS

[75] Inventor: Olivier Y. Muggli, Louisville, Ky.

[73] Assignee: Alusuisse Technology & Management Ltd., Neuhausen am Rheinfall, Switzerland

[21] Appl. No.: 09/323,269

[22] Filed: Jun. 1, 1999

[51] Int. Cl.[7] ..... B65D 83/04; B65D 85/42

[52] U.S. Cl. ..... 206/532; 206/538

[58] Field of Search ..... 206/528, 531, 206/532, 538, 570, 828

[56] References Cited

U.S. PATENT DOCUMENTS

| | | | |
|---|---|---|---|
| 4,429,792 | 2/1984 | Machbitz | 206/531 |
| 5,109,984 | 5/1992 | Romick | 206/532 X |
| 5,323,907 | 6/1994 | Kalvelage | 206/531 |

*Primary Examiner*—Jacob K. Ackun
*Attorney, Agent, or Firm*—Fisher, Christen & Sabol

[57] ABSTRACT

Packaging for tablets, capsules and the like pharmaceutical products, that is child-proof and user friendly for senior citizen, is in the form of a blister pack (12), with at least one cup (24) which accommodates the tablet (20) closed off by a push-through foil lid (26), situated in an outer packaging (10) between a base part (14) and a cover part (16). The cover part (16) is covered over by a closure part (18) such that the lid foil (16) on the blister pack (12) faces the cover part (16) and the cover part (16) features an outlet opening (32) in line with the cup (24) in the blister pack (10). A cover strip (34) which is arranged between the base part (14) and the cover part (16) covers the outlet opening (32), can be removed on opening the closure part (18) thus exposing the outlet opening (32).

49 Claims, 4 Drawing Sheets

CHILDPROOF PACKAGING FOR TABLETS

BACKGROUND OF THE INVENTION

1. Field of the Invention

The invention relates to childproof packaging for tablets, capsules and the like pharmaceutical products, said packaging being a blister pack with at least one cup closed off by a foil lid through which the tablets etc., can be pushed in order to remove them from the packaging.

2. Background Art

The danger of uncontrolled consumption of medicaments is undisputed, children in particular being exposed to this potential danger if medicaments are left lying around.

Blister packs are the most common form of packaging tablets and capsules. Widely known are the so called push-through types of packaging in which the tablet is accessed by pushing it out of a cup in the base through a foil lid. In other known forms of blister pack a foil type lid is removed by a peeling action. Other blister packs feature a notch as an aid to tearing.

Possibilities already available for increasing child safety with respect to blister packs for tablets and capsules are such that various measures are taken to make the opening of the pack more difficult—requiring more strength e.g. in the form of thicker push-through foils, increased adhesion for peeling films or greater resistance to tearing at notches.

Packaging forms that can only be opened by applying greater force do indeed provide greater safety for children; they can however present problems for senior citizens.

The object of the present invention is therefore to provide childproof packaging of the kind mentioned at the start, but which can be opened by senior citizens without difficulty. Essentially it concerns designing the packaging such that on order to open the package, one must be capable of performing a series of movements or such that call for co-ordination or combination of individual steps.

BROAD DESCRIPTION OF THE INVENTION

That objective is achieved by way of the invention in that the blister pack is situated in an outer packaging between a base part and a cover part, and the cover part is covered over by a closure part, the lid foil of the blister pack faces the cover part, and the cover part features an outlet opening facing the cup in the blister pack and a cover strip which, as desired covers over an outlet opening and after opening the closure part can be removed exposing the outlet opening, is provided between the base part and the cover part, or b) the outlet opening is covered over by a tear-back part that is releasably attached to the cover part and at least partially closes off the outlet opening, and on removal exposes the outlet opening.

In the first case opening the packaging according to the invention requires the ability to exercise combinations in the sense that after opening the closure part one must be able to recognise that, before expressing the tablet, a sliding part must be removed in order to expose the outlet opening. In the second case one must be able to recognise that after opening the closure part and before expressing the tablet, the lid foil has to be exposed in a further step.

The closure part is preferably releasably joined to the cover part e.g. at a local adhesive spot.

A preferred version of the packaging according to the invention is such that the cover strip or tear-back part is also releasably attached to the cover strip, whereby a particularly useful solution is such that the cover strip or tear-back strip can be separated from the cover part at a line of weakness, preferably a line of perforations.

It is of advantage for the cup in the blister pack to project out of the plane formed by the base part, whereby in the simplest case the cup in the blister pack penetrates an opening in the base part. If the base part is made of a formable material, then a cup may also be formed in that material and the cup in the blister pack accommodated in the cup in the base part.

A particularly cost favorable version is such that the outer packaging is made from a single preform.

Starting form two mirror-image packaging parts it is possible to manufacture a double portion pack in a simple manner. This can be e.g. designed in such a manner that each packaging part forms the closure part for the other.

At least two packs may be joined up to make multi-portion packs, the individual packs being arranged as strip packs in rows, preferably separable from each other by way of a line of perforations.

The packaging according to the invention may be manufactured using currently known rigid, semi-rigid and flexible materials of a few $\mu$m to a few mm in thickness, for example from 8 $\mu$m to 3 mm, these in the form of sheets, foils, laminates or other materials used in packaging manufacture. Examples of foil type materials are metal foils such as aluminium foils. Further examples of foil type materials are paper, semi-cardboard and cardboard. Significant in particular are also foils containing plastic e.g. plastics based on polyolefins such as polyethylenes or polypropylenes, polyamides, polyvinylchloride, polyesters such as polyalkylene-terephthalates and in particular polyethylene-terephthalate. The foils containing plastics may be monofilms of plastics, laminates of two or more plastic films, laminates of metal foils and plastic films, laminates of papers and plastic films or laminates of paper and metal foils and plastic films. The individual layers of foil-shaped materials may be attached to each other by means of adhesives, laminating adhesives, bonding agents and/or by extrusion coating, coextrusion or laminating etc. Suitable plastic films are e.g. non-oriented or mono- or biaxially oriented monofilms or laminates of two or more non-oriented or mono- or biaxially oriented films of plastic based on polyolefins such as polyethylenes or polypropylenes, polyamides, polyvinylchloride, polyesters such as polyalkylene-terephthalates and in particular polyethylene-terephthalate, cyclo-olefin-copolymers (COC) and polychlorotrifluoroethylenes (PCTFE, tradename ACLAR).

Particularly suitable for the base parts of blister packs are transparent plastics with good shape-forming characteristics such as polyethylene, polypropylene, cyclo-olefin-copolymer, polyvinylchloride, polyethylene-terephthalate, polyamide, polychlorotrifluoroethylenes and laminates manufactured out of the mentioned materials e.g. PVC and polychlorotrifluoroethylene or PVC and PVDC (polyvinyldichloride). For non-transparent blister packs use is made e.g. of laminates featur-ing aluminium foil clad on both sides with a plastic film, having e.g. a layer structure of polyamide/aluminium/PVC or plastic films containing pigments. The lid foil is normally an aluminium foil, which is lacquer coated and/or coated with a hot sealing lacquer.

All papers, semi-cardboards and cardboards and plastic films mentioned above, in the form of monofilms or laminates etc., may contain at least one continous layer of sputtered or vacuum deposited anorganic ceramic materials, for example $Al_2O_3$ or $SiO_x$, wherein x has a value of 1.5 to 2, in a thickness of for example 5 to 500 Nanometers. Said layer or layers of ceramic materials have barrier properties and avoid the diffusion of gases and moisture through the packaging.

BRIEF DESCRIPTION OF THE DRAWINGS

Further advantages, feature and details of the invention are revealed in the following description of preferred exemplified embodiments and with the aid of the drawing which shows schematically in.

DETAILED DESCRIPTION OF THE INVENTION

Figure 1:
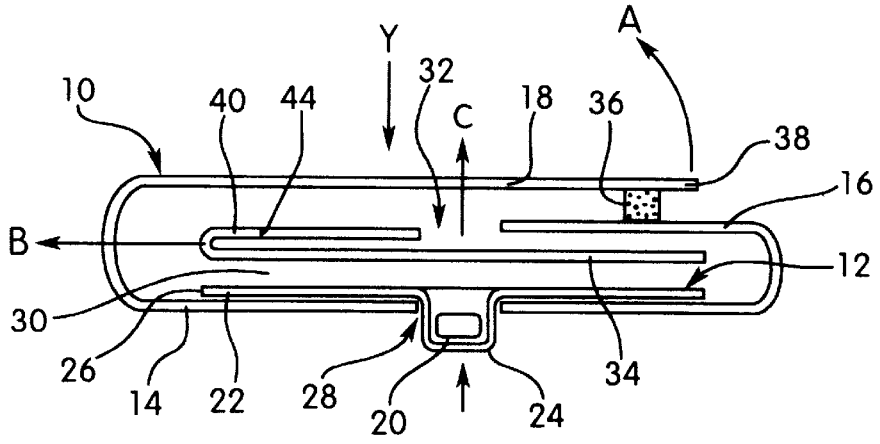
FIG. 1. a longitudinal section through a first version of a blister pack with outer packaging.
Figure 2:
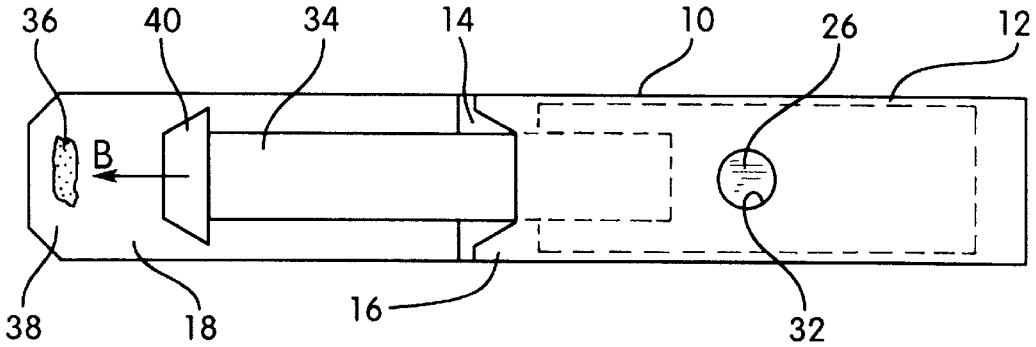
FIG. 2. a plan view of the partially opened outer packaging shown in FIG. 1, viewed in the direction y.
Figure 3:
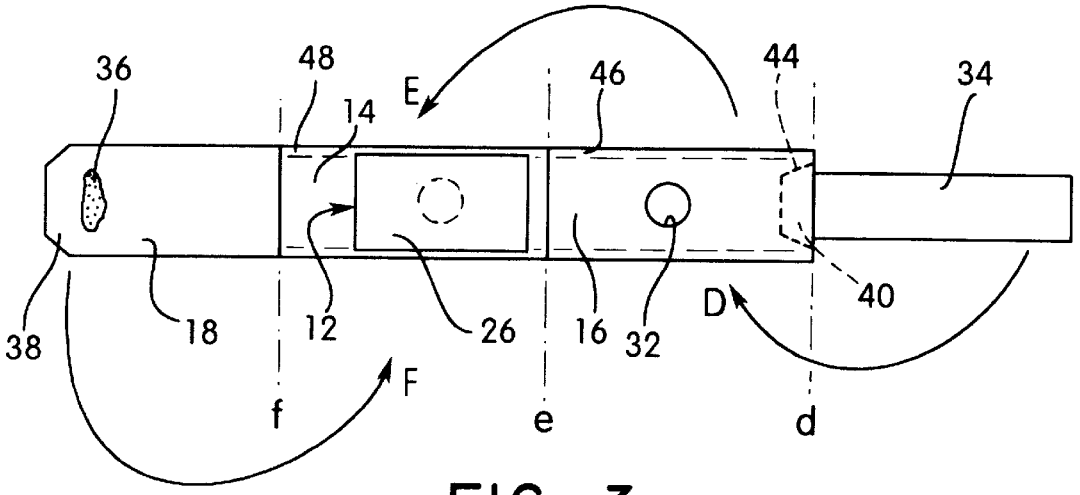
FIG. 3. a plan view of a preform for manufacturing the outer packaging shown in FIG. 1.

Shown in FIGS. 1 to 3 is a first version of an outer packaging 10 for a blister pack 12 made e.g. of cardboard, essentially strip shaped and featuring a cover part and a closure part 18. The blister pack 12—in the example shown a single portion pack for a tablet 20—features a base part 22 e.g. of polypropylene (PP) with a cup 24 shaped to accommodate the tablet 20, and a foil lid 26 e.g. of aluminium which is sealed or adhesively bonded to the base part 22. The cup 24 of the blister pack 12 penetrates an opening 28 in the base part 14 and projects out of the base part 14—the size of the opening being made to suit the size of the cup 24. The base part 22 of the blister pack 12 lies on the inside of the base 14 of the outer packaging 10 and, if desired, may be partly stuck to it. Instead of the base opening 28—and provided the material permits it—a cup may also be formed in the base part 14 i.e. the cup in the blister pack would be accommodated by a cup 24 in the base part 14.

The cover part 16 of the outer packaging 10 is joined in one piece to the base part 14 and forms with that a loop such that the cover part 16 and the base part 14 run approximately parallel to each other forming a space 30. The cover part 16 exhibits an opening 32—for removing the medicament—situated over the opening in the base and cup 24. This opening 32 is closed off by a cover strip 34 which projects into the space 30 from the opening side of the loop formed by the base part 14 and cover part 16. As explained below with the aid of FIG. 3 the cover strip 34 is likewise joined in one piece to the cover part 16 and can be released from the cover part 16 via a line of weakness or line of perforations 44, in which process a pulling flap 40 is formed.

The closure part 18 is likewise joined in one piece to the base part 14 forming a loop, whereby the closure part 18 with the integral pulling flap 40 of the cover strip 34 extends over the free end of the cover part 16. In the region of its free end the closure part 18 is attached to the underlying cover part 16 via an adhesive zone 36.

To remove the tablet 20, first the closure part 18 is gripped at its free end acting as a pulling flap 38 and the closure part 18 separated at the adhesive zone from the underlying cover part 16. An opening movement indicated by the arrow A provides access to the pulling flap 40. After opening the closure part 18 in the direction A, the cover strip 34—after removing the flap 40 on it—is pulled in direction B from the space 30. In that process the opening 32 is exposed to the space 30 and lies free—separated only by the foil lid 26—opposite the tablet in the cup 24. In this position, by applying pressure with a finger to the cup 24 in the direction C, the tablet 20 can be pushed out through the foil lid 26 and through the opening 32. The opening 32 can, additionally, be covered over by a push-through closure. This additional closure is delimited by a line of weakness e.g. a line of perforations and is separated simultaneously on pushing the tablet through the lid foil 26. The additional closure serves as a means of camouflage for the opening mechanism and protects the foil lid 26 from premature rupture e.g. by a child's finger-nail or teeth.

The essentially strip shaped preform for the outer packaging 10 in FIG. 3 shows the weakened and therefore easily separable connection between the flap 40 of the pulling tab 34 and the cover part 16 as perforation lines 44. The blister pack 12 is already lying on the base part 14 i.e. the cup 24 penetrates the base opening 28. The closing of the of the outer packaging 10 takes place in a first step by folding the cover strip 34 over in the direction D about a folding line d until the cover strip 34 lies on the cover part 16. Following that, the cover part 16 with the cover strip 34 on it is bent over in the direction B about a folding line e until it rests on the base part 14 or blister pack 12. This step is accompanied by at least partial adhesion of edge regions 46 of cover part 16 to edge regions 48 on the base part 14 to form a space 30 providing alignment for the cover strip 34. In the final step the closure part 18 is folded in direction F about a folding line f until it makes contact with the cover part 16 and is fixed in place by the adhesive in region 36.

Figure 4:
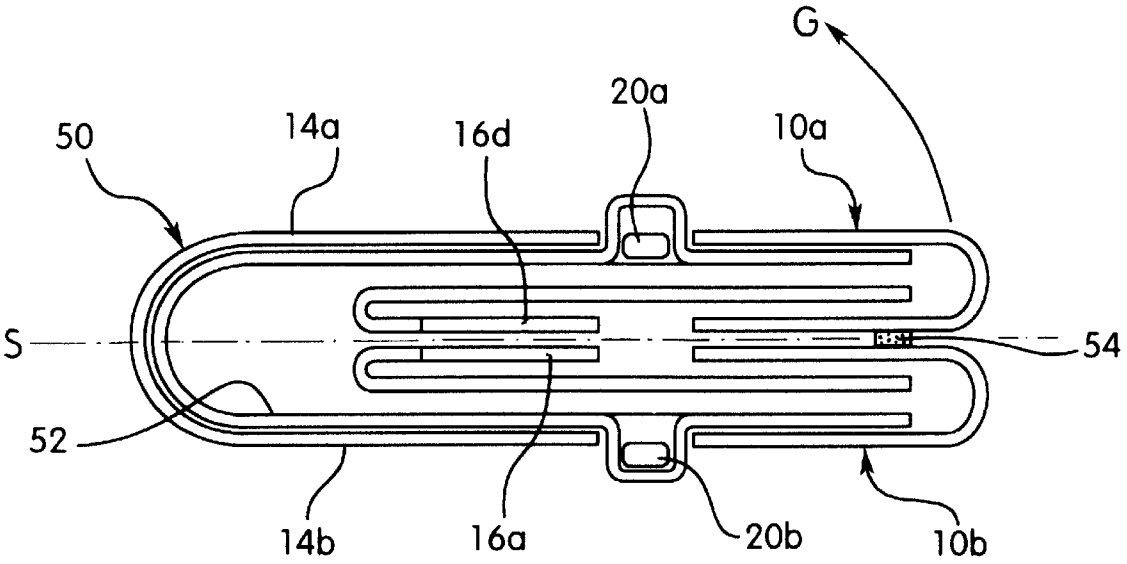
FIG. 4. a longitudinal section through a blister pack analogous to the blister pack in FIG. 1 with the outer packaging in the form of a double pack.
Figure 5:
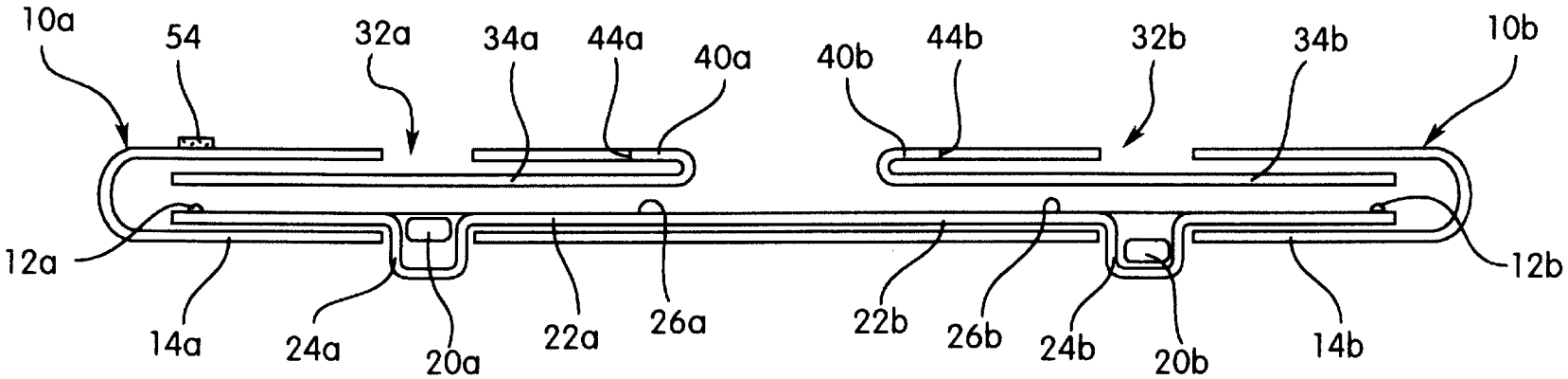
FIG. 5. a plan view of the partially opened outer packaging shown in FIG. 4.
Figure 6:
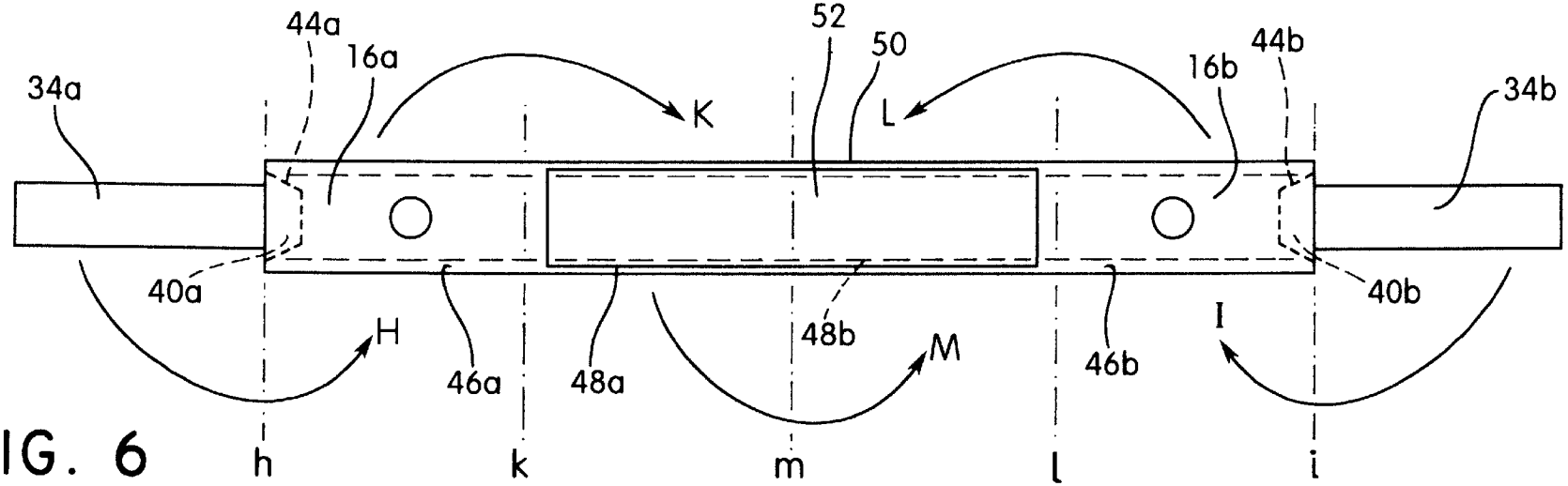
FIG. 6. a plan view of a preform for manufacturing the outer packaging shown in FIG. 4.

FIG. 4 shows an outer packaging 50 for a blister pack 52—in the example shown a two portion pack 50—comprised essentially of the form of outer packaging 10 in FIG. 1 in mirror image. The same parts are therefore also indicated by the same reference numbers, the double nature of the item being expressed by way of the letters a and b. Instead of a closure part 18 the base parts 14*a, b* are joined together in one piece and in the closed pack run approximately parallel to each other. At the same time both cover parts 16*a, b* lie against each other and are stuck together in that position by adhesive at location 54. In this closed position the two parts 10*a* and 10*b* of the outer packaging 50 lie on either side of a mirror image plane S. To open the outer packaging 50, part 10*a* is separated from part 10*b* at the point of joining 54, opened out in the direction of the arrow G and laid in the open position shown in FIG. 5. In this position both partially opened parts 10*a, b* can be opened in the same manner and the tablets 20*a, b* removed in the same manner as shown in FIGS. 1 to 3 for outer packaging 10. The length of preform of an outer packaging 50 for a two portion pack is closed in a manner analogous to the single portion pack shown in FIG. 3. In this case first both cover strips 34*a, b* are folded inwards in the direction H and I about the respective folding line h and i. Following that, the cover parts 16*a, b* along with the cover strips 34*a,* 34*b* are folded inwards in the directions K and L about the respective folding lines k and l until they come to rest on the base parts 14*a, b,* each on one half of the blister pack 52. Finally the base part 14*a* is folded in the direction M about folding line m, which corresponds with the axis of symmetry of the preform, until both parts 10*a,b* of the outer packaging make contact whereupon theses two halves are joined together at the point of adhesion 54. As with the outer packaging in FIG. 3 the edge regions 46*a, b* of the cover part 16*a, b* are adhesively joined at least in part to the edge regions 48*a, b* of the base part 14*a, b* to form both spaces 30*a, b* for the cover strips 34*a, b* respectively.

Figure 7:
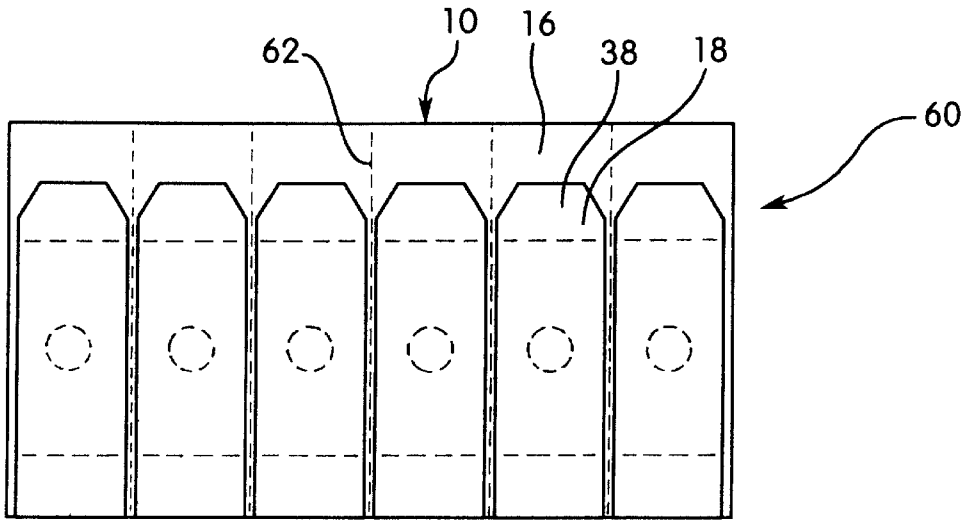
FIG. 7. a plan view of a blister pack in the form of a multi-portion pack with the outer packaging shown in FIG. 1.

FIG. 7 shows a strip-shaped form of packaging 60 with six strip-shaped individual packs of the type shown in FIG. 1 arranged in a row. These may be separated from each other along perforations 62 arranged in lines. The individual outer packaging 10 may also be opened without having to be separated from the strip 60. Such a form of packaging is suitable also for outer packaging 50 with a double portion blister pack 52 as shown in FIG. 4.

Figure 8:
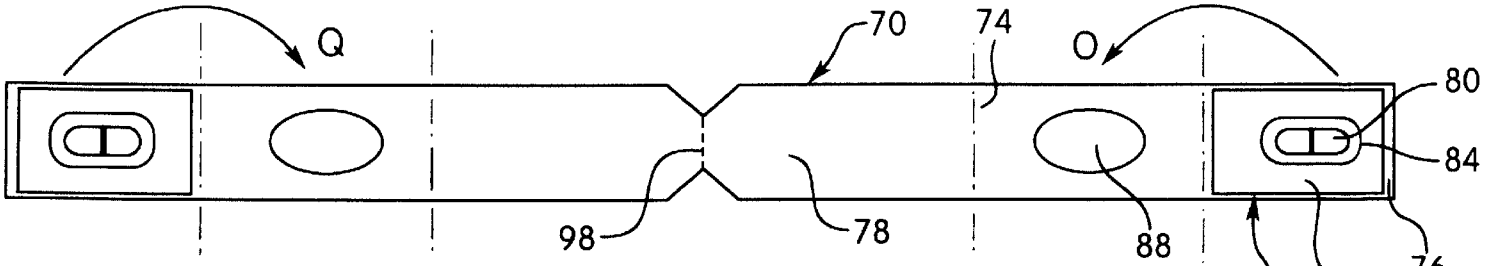
FIG. 8. a plan view of a preform for manufacturing the outer packaging of a second version of blister pack in the form of a double pack with outer packaging.
Figure 9:
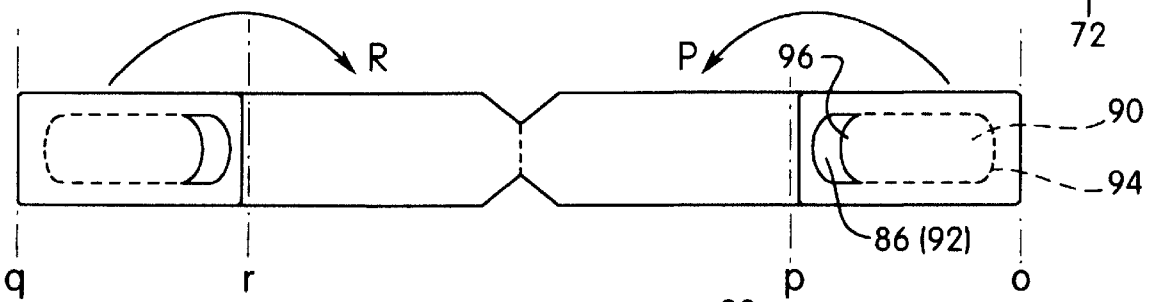
FIG. 9. a plan view of a preform as in FIG. 8 after folding over the first folding line.
Figure 10:
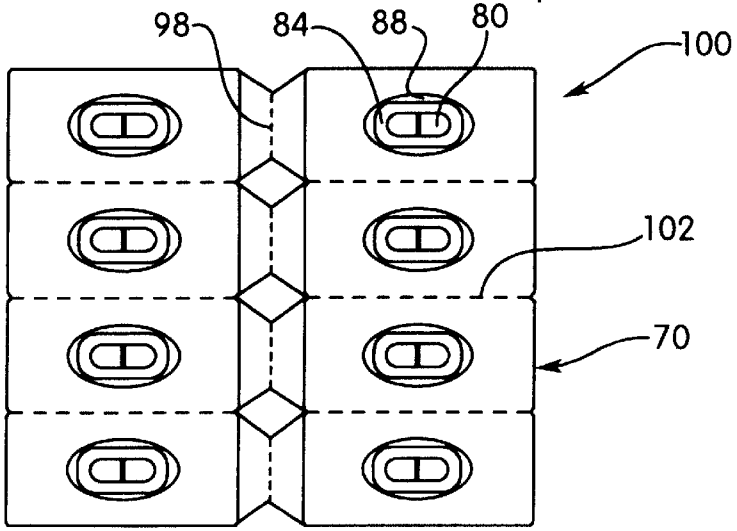
FIG. 10. a plan view of the preform as in FIG. 8 after folding over the second folding line, shown as a multi-portion version of packaging.

A second version of an outer packaging 70 shown in FIGS. 8 to 10 is in the form of a double pack e.g. of cardboard for a blister pack 72, essentially strip-shaped, features a base part 74, a cover part 76 and a closure part 78. The blister pack 72—in the example shown a single dose pack for a capsule 80—features a base part 82 e.g. of polypropylene (PP) with an integral cup 84 shaped into it to accommodate the capsule 80, and a foil lid 86 e.g. of aluminium sealed to the base part 82. The cup 84 in the blister pack 72 penetrates an opening 88 in the base part 74 of the outer packaging 70—the size of which opening 88 is selected in keeping with the size of the cup 84—and projects down out of the base part 74. The base part 82 of the blister pack 72 lies against the inner side of the base part 74 of the outer packaging 70 and may likewise be adhesively bonded in part to it. Instead of the opening 88 in the base 74—provided the material permits it—a cup may also be formed in the base part 74 i.e. the cup in the blister pack 72 would in that case be accommodated in a cup 84 in the base part 74.

The cover part 76 of the outer packaging 70 is joined in one piece to the base part 74 and, facing the base opening 88 and cup 84, features an opening 92 for removing the capsule. This opening 92 is to a large extent closed over by a tear-off part 90. The tear-off part 90 is joined to the cover part 76 via a line of weakness or line of perforations 94 and, in a non-covered region of the opening 92, forms a pulling tab 96. The closure part 78 is likewise joined in one piece to the base part 74 and is fixed in the region of its free end to the underlying cover part 76 via a point of adhesion.

In the essentially strip-shaped preform for the outer packaging 70 shown in FIG. 8 the blister pack 72 is already lying on the cover part 76. The first step in closing the outer packaging 70 is such that the cover part 76 is folded over in direction O about a folding line o until the cover part 76 and the blister pack 72 lie on the base part 74. Thereby the cup 84 penetrates the opening 88 in the base part 74. This step is accompanied by adhering at least part of the edge region of the cover part 76 to the edge region of the base part 74. Finally the base part 74 is folded along with the cover part 76 resting on it in direction P about folding line p until contact is made with the closure part 78, and the closure part 78 affixed in the region of its free end to the underlying cover part 76. The second part of the double portion pack is folded in the same manner in directions Q, R about folding lines q, r respectively. Both parts of the double portion pack may be separated along a central line of perforations 98.

Shown in FIG. 10 are four strip-shaped double packs of a multi-portion pack 100 with eight individual single portion packs in a row. These may be separated from each other along perforation lines 102. The individual outer packs 70 may however also be opened without having to separate them from the pack 100.

What is claimed is:

1. Childproof packaging for a pharmaceutical product, comprising: a blister pack (12) with at least one cup (24) closed off by a foil lid (26) through which the pharmaceutical product (20) can be pushed in order to remove them from the packaging, the blister pack (12) is situated in an outer packaging (10) between a base part (14) and a cover part (16), and the cover part (16) is covered over by a closure part (18), the foil lid (26) of the blister pack (12) faces the cover part (16), and the cover part (16) has an outlet opening (32) which is correlated with the cup (24) in the blister pack (10), cover strip (34) is provided between the base part (14), and the cover part (16), which covers strip (34) can be removed after opening the closure part (18) thereby exposing the outlet opening (32).

2. The packaging according to claim 1 wherein the outlet opening (32) is covered by a penetrable lid.

3. The packaging according to claim 1 wherein the pharmaceutical product is a tablet or a capsule.

4. The packaging according to claim 1, wherein the closure part (18) is releasably attached to the cover part (16).

5. The packaging according to claim 5, wherein the cover strip (34) is releasably joined to the cover part (16).

6. The packaging according to claim 5, wherein the cover strip (34) is joined to the cover part (16) via a line of weakness.

7. The packaging according to claim 6, wherein the line of weakness is a line of perforations (44).

8. The packaging according to claim 6, wherein the cup (24) in the blister pack (12) projects out of plane formed by the base part (14).

9. The packaging according to claim 8, wherein the cup (24) in the blister pack (12) penetrates an opening (28) in the base part (14).

10. The packaging according to claim 9, wherein a cup is formed in the base part (14) and the cup (24) in the blister pack (12) is aligned with the cup in the base part (14).

11. The packaging according to claim 10, wherein the outer packaging (10) is made from a single preform.

12. The packaging according to claim 1, wherein the cover strip (34) is joined to the cover part (16) via a line of weakness.

13. The packaging according to claim 12, wherein the line of weakness is a line of perforations (44).

14. The packaging according to claim 1, wherein the cup (24) in the blister pack (12) projects out of a plane formed by the base part (14).

15. The packaging according to claim 1, wherein the cup (24) in the blister pack (12) penetrates an opening (28) in the base part (14).

16. The packaging according to claim 1, wherein a cup is formed in the base part (14) and the cup (24) in the blister pack (12) is aligned with the cup in the base part (14).

17. The packaging according to claim 1, wherein the outer packaging (10) is made from a single preform.

18. Childproof packaging for pharmaceutical products, comprising: a double pack having two pack parts each of which is a mirror image of each other, each pack part comprising: a blister pack (12) with at least one cup (24) closed off by a foil lid (26) through which the pharmaceutical product (20) in order to remove them from the packaging, the blister pack (12) is situated in an outer packaging (10) between a base part (14) and a cover part (16), and the cover part (16) is covered over by a closure part (18), the foil lid (26) of the blister pack (12) faces the cover part (16), and the cover part (16) has an outlet opening (32) which is correlated with the cup (24) in the blister pack (10), cover strip (34) is provided between the base part (14), and the cover part (16), which covers strop (34) can be removed after opening the closure part (18) thereby exposing the outlet opening (32).

19. The packaging according to claim 18 wherein the outlet opening (32) is covered by a penetrable lid.

20. The packaging according to claim 18 wherein the pharmaceutical product is a tablet or a capsule.

21. The packaging according to claim 18, wherein each pack part forms the closure for the other pack part.

22. Multi-portion packaging of at least two packs according to claim 1, wherein the individual packs are arranged into strip packaging (60) and is separated from the strip (60) along a line of weakness.

23. The packaging according to claim 22, wherein the line of weakness regarding the strip (60) is a line of perforations.

24. Multi-portion packaging of at least two double packs according to claim 18, wherein the individual double packs are arranged into strip packaging (60) and is separated from the strip (60) along a line of weakness.

25. The packaging according to claim 24, wherein the line of weakness regarding the strip (60) is a line of perforations (62).

26. Childproof packaging for a pharmaceutical product, comprising: a blister pack (72) with at least one cup (84) closed off by a foil lid (86) through which the pharmaceutical product (80) can be pushed in order to remove them from the packaging, the blister pack (72) is situated in an outer packaging (70) between a base part (74) and a cover part (76), and the cover part (76) is covered over by a closure part (78), the foil lid (86) of the blister pack (72) faces the cover part (76), and the cover part (76) has an outlet opening (92) which is correlated with the cup (84) in the blister pack (70), and the outlet opening (92) is covered over by a tear-back part (90) that is releasably attached to the cover part (76) and at least partially closes off the outlet opening and on removal exposes the outlet opening (92).

27. The packaging according to claim 26 wherein the pharmaceutical product is a tablet or a capsule.

28. The packaging according to claim 26, wherein the closure part (78) is releasably attached to the cover part (16, 76).

29. The packaging according to claim 28, wherein the tear-back part (90) is releasably joined to the cover part (76).

30. The packaging according to claim 28, wherein the tear-back part (90) is joined to the cover part (76) via a line of weakness.

31. The packaging according to claim 30, wherein the line of weakness is a line of perforations (98).

32. The packaging according to claim 30, wherein the cup (84) in the blister pack (72) projects out of the plane formed by the base part (74).

33. The packaging according to claim 32, wherein the cup (84) in the blister pack (72) penetrates an opening (88) in the base part (74).

34. The packaging according to claim 33, wherein a cup is formed in the base part (74) an the cup (84) in the blister pack (12) is aligned with the cup in the base part (74).

35. The packaging according to claim 34, wherein the outer packaging (70) is made from a single preform.

36. The packaging according to claim 26, wherein the tear-back part (90) is releasably joined to the cover part (76).

37. The packaging according to claim 26, wherein the tear-back part (90) is joined to the cover part (76) via a line of weakness.

38. The packaging according to claim 37, wherein the line of weakness is a line of perforations (98).

39. The packaging according to claim 26, wherein the cup (84) in the blister pack (72) projects out of the plane formed by the base part (74).

40. The packaging according to claim 26, wherein the cup (84) in the blister pack (72) penetrates an opening (88) in the base part (74).

41. The packaging according to claim 26, wherein a cup is formed in the base part (74) and the cup (84) in the blister pack (12) is aligned with the cup in the base part (74).

42. The packaging according to claim 26, wherein the outer packaging (70) is made from a single preform.

43. Childproof packaging for pharmaceutical products, comprising a double pack having two pack parts each of which is a mirror image of each other, each pack part comprising: a blister pack (72) with at least one cup (84) closed off by a foil lid (86) through which the pharmaceutical product (80) can be pushed in order to remove them from the packaging, the blister pack (72) is situated in an outer packaging (70) between a base part (74) and a cover part (76), and the cover part (76) is covered over by a closure part (78), the foil lid (86) of the blister pack (72) faces the cover part (76), and the cover part (76) has an outlet opening (92) which is correlated with the cup (84) in the blister pack (70), and the outlet opening (92) is covered over by a tear-back part (90) that is releasably attached to the cover part (76) and at least partially closes off the outlet opening and on removal exposes the outlet opening (92).

44. The packaging according to claim 43 wherein the pharmaceutical product is a tablet or a capsule.

45. The packaging according to claim 43, wherein each pack part forms the closure for the other pack part.

46. Multi-portion packaging of at least two packs according to claim 26, wherein the individual packs are arranged into strip packaging (60) and is separated from the strip (60) along a line of weakness.

47. The packaging according to claim 44, wherein the line of weakness regarding the strip (60) is a line of perforations (62).

48. Multi-portion packaging of at least two double packs according to claim 43, wherein the individual double packs are arranged into strip packaging (60) and is separated from the strip (60) along a line of weakness.

49. The packaging according to claim 46, wherein the line of weakness is a line of perforations.

* * * * *